US007494350B1

(12) United States Patent
Lee

(10) Patent No.: US 7,494,350 B1
(45) Date of Patent: Feb. 24, 2009

(54) ELECTRICAL DEVICE WITH A RETRACTABLE PLUG

(75) Inventor: Po-Sheng Lee, Sanchung (TW)

(73) Assignee: Hipro Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 12/018,625

(22) Filed: Jan. 23, 2008

(51) Int. Cl.
*H01R 13/44* (2006.01)

(52) U.S. Cl. ..... 439/131

(58) Field of Classification Search ..... 439/131, 439/501

See application file for complete search history.

(56) References Cited

U.S. PATENT DOCUMENTS 5,971,777 A * 10/1999 Garside ..... 439/131
5,989,042 A * 11/1999 Johnson et al. ..... 439/131
6,567,273 B1 * 5/2003 Liu et al. ..... 361/737
6,568,946 B1 * 5/2003 Chou ..... 439/131
6,808,400 B2 * 10/2004 Tu ..... 439/131
6,923,666 B1 * 8/2005 Liao ..... 439/172
6,926,554 B2 * 8/2005 Liow et al. ..... 439/528
7,125,265 B2 * 10/2006 Weng ..... 439/131
7,125,282 B2 * 10/2006 Huang ..... 432/501
7,131,852 B1 * 11/2006 Chen ..... 439/131
7,307,849 B2 * 12/2007 Ho et al. ..... 361/737
7,311,460 B2 * 12/2007 Yu ..... 401/195
7,407,393 B2 * 8/2008 Ni et al. ..... 439/131
7,416,419 B2 * 8/2008 Collantes et al. ..... 439/76.1
7,425,132 B2 * 9/2008 Yang et al. ..... 439/4
2005/0153588 A1 * 7/2005 Liao ..... 439/172
2006/0172591 A1 * 8/2006 Huang ..... 439/501
2008/0045056 A1 * 2/2008 Collantes et al. ..... 439/131
2008/0227380 A1 * 9/2008 Hsu et al. ..... 454/184
2008/0233776 A1 * 9/2008 Tang et al. ..... 439/131

* cited by examiner

*Primary Examiner*—Ross N Gushi
(74) *Attorney, Agent, or Firm*—Rabin & Berdo, P.C.

(57) ABSTRACT

An electrical device with a retractable plug has a body and a plug-moving assembly. The body has a chamber, a partition and a plug. The partition is formed in the chamber, separates the chamber into a plug chamber and an electronics chamber. The plug chamber has a longitudinal sidewall, a slot and an opening. The longitudinal sidewall is disposed parallelly with the partition and has an inner surface. The slot is formed through the longitudinal sidewall. The opening is formed through the end wall. The plug-moving assembly is mounted in the plug chamber and connects to the plug to selectively retract the plug into the plug chamber. Therefore, the plug of the electrical device may be selectively retracted to prevent prong damage, improve safety and aesthetics of design.

9 Claims, 3 Drawing Sheets

ELECTRICAL DEVICE WITH A RETRACTABLE PLUG

BACKGROUND OF THE INVENTION

1. Field of the Invention

The present invention relates to an electrical device with a plug, especially to an electrical device with a retractable plug.

2. Description of the Prior Arts

Conventional electrical appliances and devices have a body, a cable and a plug. The cable is connected between the body and the plug.

However, the plug is not aesthetically pleasing and the wire of the apparatus may become tangled on a floor of a house. Furthermore, when traveling, cables are awkwardly shaped and may jut out of soft cases, or their prongs broken by hard cases.

Furthermore, when left unplugged, the plug may be trodden on causing painful annoyance and the prongs to be broken, leading to disposal of the plug, or the prongs may be damaged causing unsafe connection and risk of electrocution or fire.

To overcome the shortcomings, the present invention provides an electrical device with a retractable plug to mitigate or obviate the aforementioned problems.

SUMMARY OF THE INVENTION

The main objective of the present invention is to provide an electrical device with a retractable plug, especially to an electrical device with a retractable plug that prevents prong breakage, eases portability and improve aesthetics.

An electrical device with a retractable plug has a body and a plug-moving assembly. The body has a chamber, a partition and a plug. The partition is formed in the chamber, separates the chamber into a plug chamber and an electronics chamber. The plug chamber has a longitudinal sidewall, a slot and an opening. The longitudinal sidewall is disposed parallelly with the partition and has an inner surface. The slot is formed through the longitudinal sidewall. The opening is formed through the end wall. The plug-moving assembly is mounted in the plug chamber and connects to the plug to selectively retract the plug into the plug chamber. Therefore, the plug of the electrical device may be selectively retracted to prevent prong damage, improve safety and aesthetics of design.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
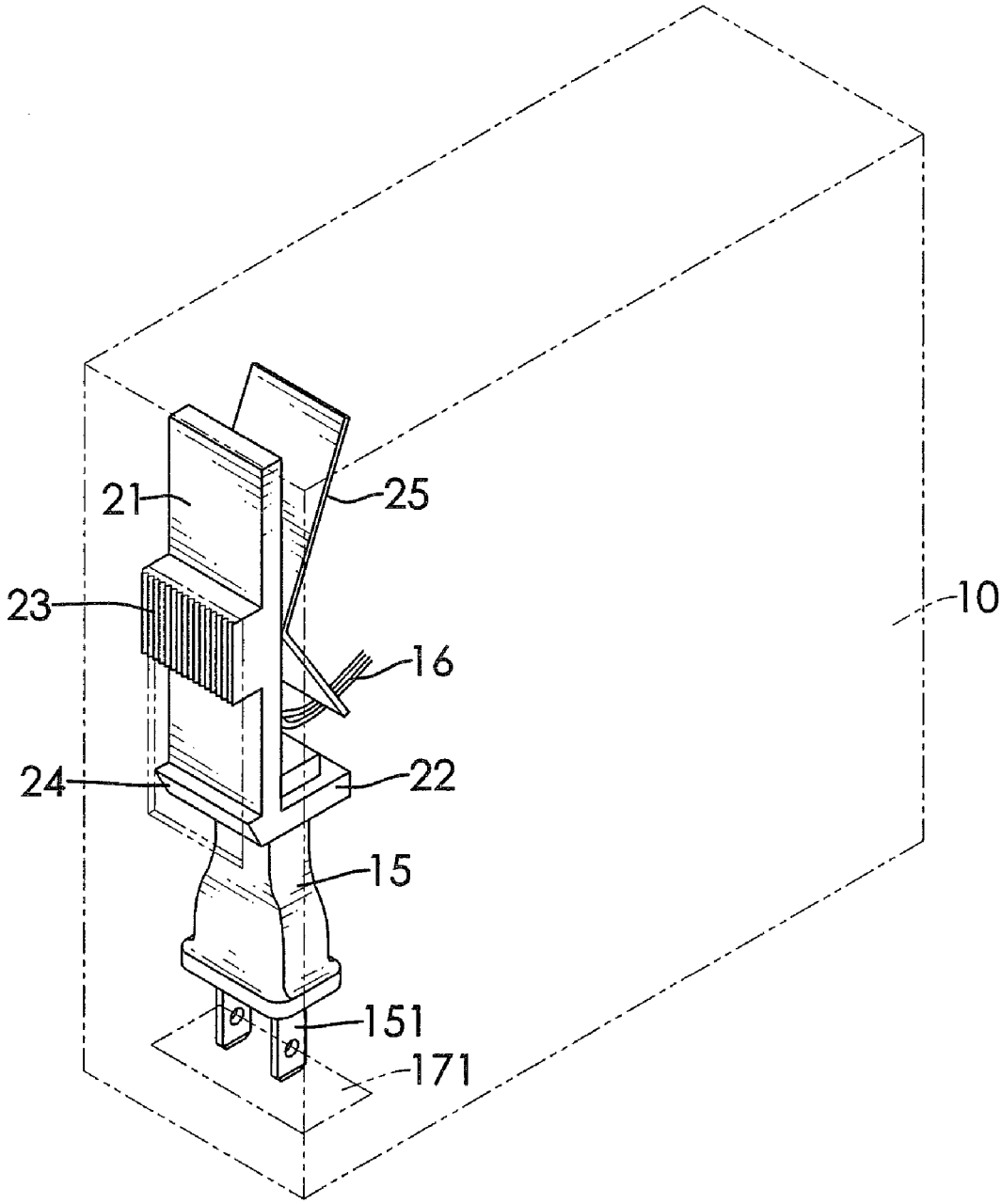
FIG. 1 is a perspective of an electrical device with a retractable plug in accordance with the present invention.

With reference to FIG. 1, an electrical device with a retractable plug in accordance with the present invention comprises a body (10) and a plug-moving assembly.

Figure 2:
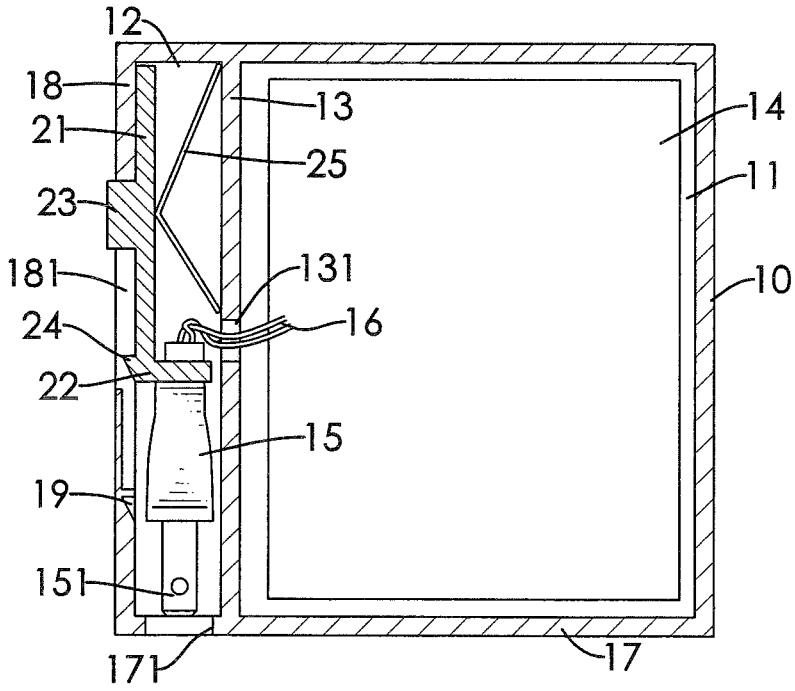
FIG. 2 is an operational side view in partial section of the electrical device in FIG. 1, shown the plug being retracted.
Figure 3:
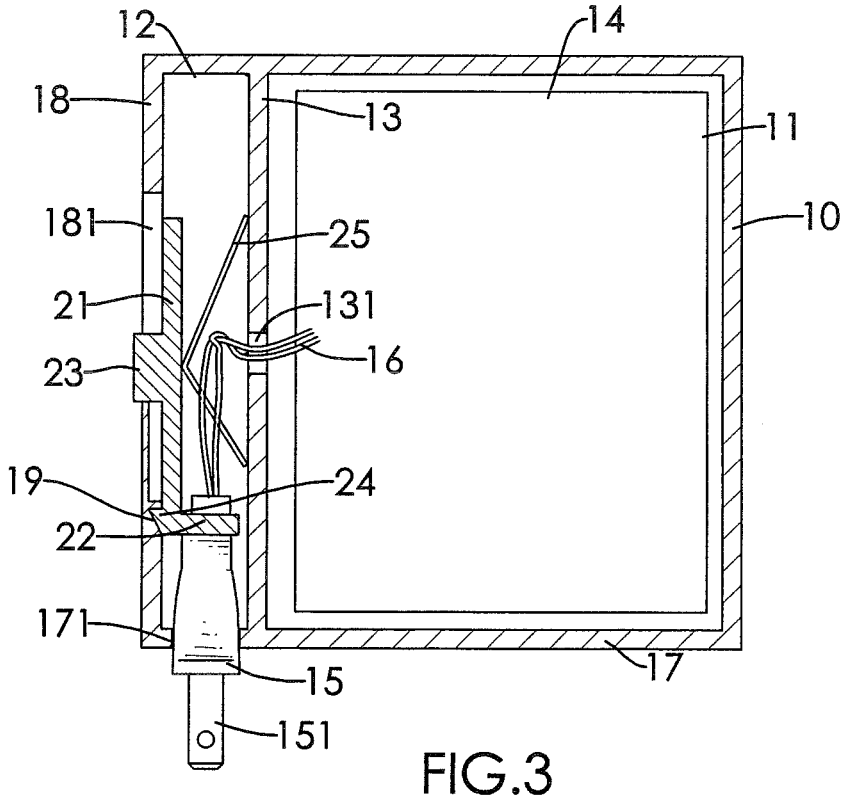
FIG 3 is an operational side view in partial section of the electrical device in FIG. 1 shown the plug protruding.
Figure 4:
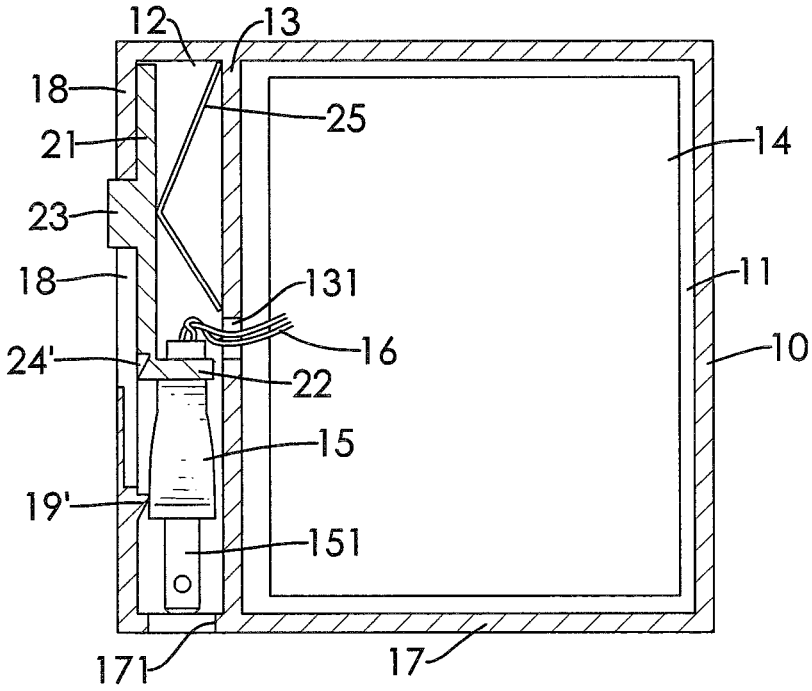
FIG. 4 is an operational side view in partial section of another embodiment of the electrical device in accordance with the present invention, shown the plug being retracted.
Figure 5:
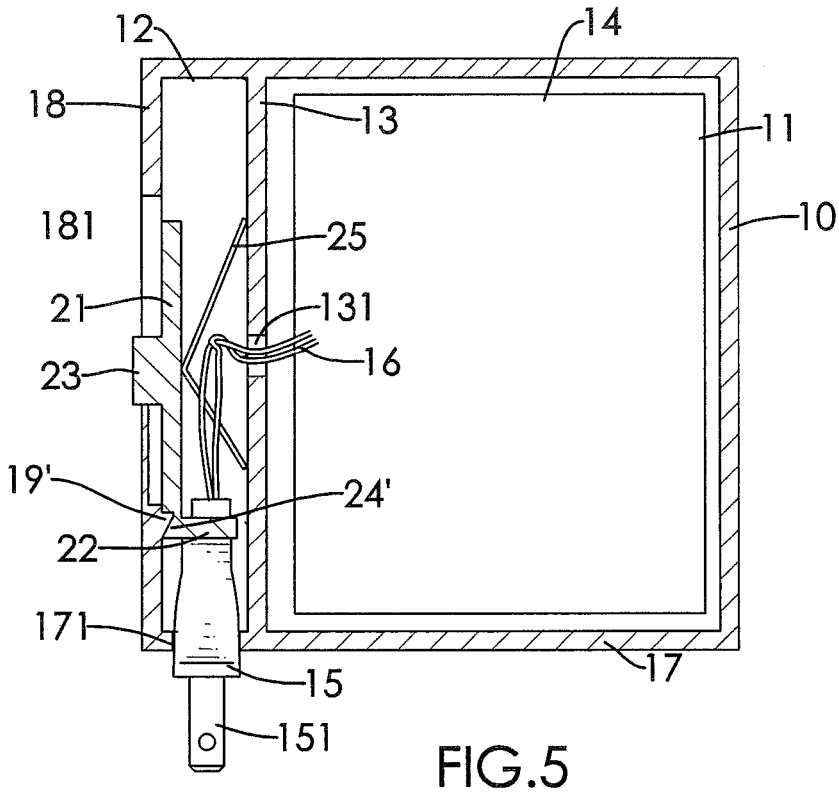
FIG. 5 is an operational side view in partial section of the electrical device in FIG. 4, shown the plug protruding.

With further reference to FIGS. 2, and 4, the body (10) has an outer surface, an end wall (17), a chamber, a partition (13), a circuit board (14), a plug (15) and a cable (16).

The partition (13) is formed in the chamber, separates the chamber into a plug chamber (12) and an electronics chamber (11) and has a through hole (131). The through hole (131) is formed through the partition (13).

The plug chamber (12) has a longitudinal sidewall (18), a slot (181) and an opening (171). The longitudinal sidewall (18) is disposed parallelly with the partition (13) and has an inner surface and a positioning element (18, 19'). The positioning element (19, 19') is formed on the inner surface of the longitudinal sidewall (18) and may be a detent (19) or a protrusion (19'). The slot (181) is formed through the longitudinal sidewall (18) near the positioning element (19, 19'). The opening (171) is formed through the end wall (17).

The circuit board (14) is mounted in the electronics chamber (11). The plug (15) is mounted movably in the plug chamber (12) and has a proximal end and a distal end. The plug (15) may be an ordinary electrical plug with two electrodes (151), an USB connector, or the like. The distal end of the plug (15) selectively extends through the opening (171). The cable (16) electrically connects between the circuit board (14) and the proximal end of the plug (15) and is mounted through the through hole (131) of the partition (13).

The plug-moving assembly is mounted in the plug chamber (12) and connects tho the plug (15) to selectively retract the plug (15) into the plug chamber (12). The plug-moving assembly comprises a bracket (21), a plug mount (22), a button (23), a positioning element (24, 24') and a resilient device (25).

The bracket (21) is mounted slidably in the plug chamber (12) and has an outer surface and a mounting end. The plug mount (22) is formed on and protrudes from the mounting end of the bracket (21) and connects to the plug (15). The button (23) is formed on and protrudes from the outer surface of the bracket (21), is mounted through the slot (181) and may comprise multiple ribs for improving grip. The positioning element (24, 24') of the plug-moving assembly is formed on the outer surface of the bracket (21) near the mounting end of the bracket (21) and corresponds to and selectively engage the positioning element (19, 19') of the body (10). The positioning element (24, 24') may be a protrusion (24) or a detent (24'). The resilient device (25) is mounted securely on the bracket (21) and presses the bracket (21) against the longitudinal wall (18).

When the plug (15) is used, the bracket (21) is slid by using the button (23), until the positioning elements (19, 19', 24, 24') temporarily lock the plug (15) into a protruding position to be easily inserted into a socket.

When the plug (15) is not in use, the bracket (21) is slid back to retract the plug (15) into the plug chamber (12) of the body (10).

Therefore, storage of electrical device as described is enhanced, since the plug (15) need not be left lying on the floor when not in use so cannot be trodden on.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical device with a retractable plug comprising a body having an outer surface;

an end wall;

a chamber;

a partition being formed in the chamber, separating the chamber into a plug chamber and an electronics chamber and having a through hole being formed through the partition, and the plug chamber having a longitudinal sidewall being disposed parallelly with the partition and having an inner surface; and a slot being formed through the longitudinal sidewall; and an opening being formed through the end wall;

a circuit board being mounted in the electronics chamber;

a plug being mounted movably in the plug chamber and having a proximal end and a distal end selectively extending through the opening of the body; and a cable connecting between the circuit board and the proximal end of the plug and being mounted through the through hole of the partition; and a plug-moving assembly being mounted in the plug chamber, connecting to the plug and having a bracket being mounted slidably in the plug chamber and having an outer surface; and a mounting end;

a plug mount being formed on and protruding from the mounting end of the bracket and connecting to the plug;

a button being formed on and protruding form the outer surface of the bracket and being mounted through the slot; and a resilient device being mounted securely on the bracket and pressing the bracket against the longitudinal wall.

2. The electrical device with a retractable plug as claimed in claim 1, wherein the button having multiple ribs.

3. The electrical device with a retractable plug as claimed in claim 1, wherein the bracket of the plug-moving assembly is perpendicular to the plug mount of the plug-moving assembly.

4. The electrical device with a retractable plug as claimed in claim 3, wherein the longitudinal sidewall of the body further has a positioning element being formed on the inner surface of the longitudinal sidewall; and the bracket of the plug-moving assembly further has a positioning element being formed on the outer surface of the bracket near the mounting end of the bracket and corresponding to and selectively engaging the positioning element of the body.

5. The electrical device with a retractable plug as claimed in claim 4, wherein the positioning element of the longitudinal sidewall is a detent; and the positioning element of the bracket is a protrusion.

6. The electrical device with a retractable plug as claimed in claim 4, wherein the positioning element of the bracket is a detent; and the positioning element of the longitudinal sidewall is a protrusion.

7. The electrical device with a retractable plug as claimed in claim 1, wherein the longitudinal sidewall of the body further has a positioning element being formed on the inner surface of the longitudinal sidewall; and the bracket of the plug-moving assembly further has a positioning element being formed on the outer surface of the bracket near the mounting end of the bracket and corresponding to and selectively engaging the positioning element of the body.

8. The electrical device with a retractable plug as claimed in claim 7, wherein the positioning element of the longitudinal sidewall is a detent; and the positioning element of the bracket is a protrusion.

9. The electrical device with a retractable plug as claimed in claim 7, wherein the positioning element of the bracket is a detent; and the positioning element of the longitudinal sidewall is a protrusion.

* * * * *